US006076273A

United States Patent [19]

Corner

[11] Patent Number: 6,076,273

[45] Date of Patent: Jun. 20, 2000

[54] STABILIZED VACUUM APPARATUS FOR INDUSTRIAL MULTIPLE-BED HIDE DRIERS

[75] Inventor: Antonio Corner, deceased, late of Thiene, Italy, by Antonio Polato, legal representative

[73] Assignee: Officine Di Cartigliano, S.p.A., Thiene, Italy

[21] Appl. No.: 08/525,604

[22] PCT Filed: Mar. 21, 1994

[86] PCT No.: PCT/EP94/00876

§ 371 Date: Aug. 26, 1997

§ 102(e) Date: Aug. 26, 1997

[87] PCT Pub. No.: WO94/23255

PCT Pub. Date: Oct. 13, 1994

[30] Foreign Application Priority Data

Mar. 26, 1993 [IT] Italy ..... VI93A0046

[51] Int. Cl.[7] ..... F26B 5/04

[52] U.S. Cl. ..... 34/92

[58] Field of Search ..... 34/60, 92, 209, 34/210, 558, 559, 565, 566, 570, 589, 579, 202, 218

[56] References Cited

U.S. PATENT DOCUMENTS

| | | | |
|---|---|---|---|
| 3,302,303 | 2/1967 | Aupoix | 34/145 |
| 3,736,016 | 5/1973 | Margittai | 34/92 |
| 3,987,556 | 10/1976 | Tissot et al. | 34/155 |
| 4,104,805 | 8/1978 | Margittai | 34/92 |
| 4,137,648 | 2/1979 | Rhodes | 34/86 |
| 4,147,511 | 4/1979 | Bartlett | 8/94.18 |
| 5,033,206 | 7/1991 | Corner | 34/92 |
| 5,056,239 | 10/1991 | Corner | 34/92 |
| 5,647,945 | 7/1997 | Matsuse et al. | 156/345 |
| 5,819,436 | 10/1998 | Helevirta | 34/408 |

FOREIGN PATENT DOCUMENTS

| | | | |
|---|---|---|---|
| 625703 | 7/1949 | United Kingdom | 34/92 |

*Primary Examiner*—Henry Bennett
*Assistant Examiner*—Pamela A. Wilson
*Attorney, Agent, or Firm*—R. Neil Sudol; Henry D. Coleman

[57] ABSTRACT

The invention relates to a stabilized vacuum apparatus for industrial hide driers with multiple evaporation beds. The apparatus includes a main vacuum source that can be connected to a series of evaporation beds to produce a negative pressure having a preset value in the beds, in steady-state operating conditions. There is a secondary vacuum source which is suitable to produce, in one bed at a time, a negative pressure which is close to the steady-state value, and there is a valve means to selectively connect each bed, which is initially at ambient pressure, first to the secondary vacuum source and then to the main vacuum source, so as to eliminate substantial pressure variations in the remaining beds when each bed is connected to the main vacuum source. The valve means includes, for each bed, a first electric valve on a line for connection to the outside environment, a second electric valve on a line for connection to the secondary vacuum source, and a third electric valve on a line for connection to the main vacuum source. There is also a control unit suitable to control the cyclic sequential opening and closure of the first, second and third electric valves of each bed.

7 Claims, 1 Drawing Sheet

STABILIZED VACUUM APPARATUS FOR INDUSTRIAL MULTIPLE-BED HIDE DRIERS

The present invention relates to a stabilized vacuum apparatus for industrial hide driers with multiple evaporation beds, of the type that includes a main vacuum source that can be connected to a series of evaporation beds and is suitable to produce a negative pressure having a preset value in the beds, when the system is running in the steady state, so as to facilitate evaporation and condensation of the moisture contained in the hides applied to the beds.

A vacuum system of the above mentioned type is disclosed for example, in the Italian patent application No. VI93A000041, the contents of which are considered as reference in the present invention.

As is known, the beds of vacuum driers have covers that can be opened to load and unload the hides to be dried. Once a bed has been opened, it is disconnected from the vacuum source and is reconnected to it after placing the hides and closing the cover again. During this step, the pressure produced in the remaining beds, which are still closed, rises suddenly because the beds are simultaneously connected to the same vacuum source, which is normally constituted by one or more vacuum pumps and/or blowers.

Accordingly, a cyclic variation of the pressure occurs in the beds, increasing the time required to stabilize the pressure at its normal operating value. This negatively affects the productivity and quality of the hides, which are accordingly stressed in a cyclic manner and can have unevenly dried regions at the end of the treatment.

The aim of the present invention is to eliminate this drawback by providing a vacuum apparatus that in steady-state running conditions can produce in the beds a negative pressure whose value is substantially constant, independently of the opening and closing of each bed during the unloading and loading of the hides from it.

This aim is achieved by virtue of a secondary vacuum source which is suitable to create, in one bed at a time, after the bed has closed, a negative pressure which is close to the steady-state pressure, a valve means being provided to selectively connect each bed, which is initially at ambient pressure, first to the secondary vacuum source and then to the main vacuum source.

This arrangement allows to gradually reduce the pressure in each bed that is initially at atmospheric pressure without affecting at all the remaining beds and eliminates pressure variations in all the beds when the bed that is initially at atmospheric pressure is connected to the main vacuum source.

Further characteristics and advantages will become apparent from the detailed description of a preferred embodiment, illustrated only by way of non-limitative example in the accompanying drawings, wherein.

Figure 1:
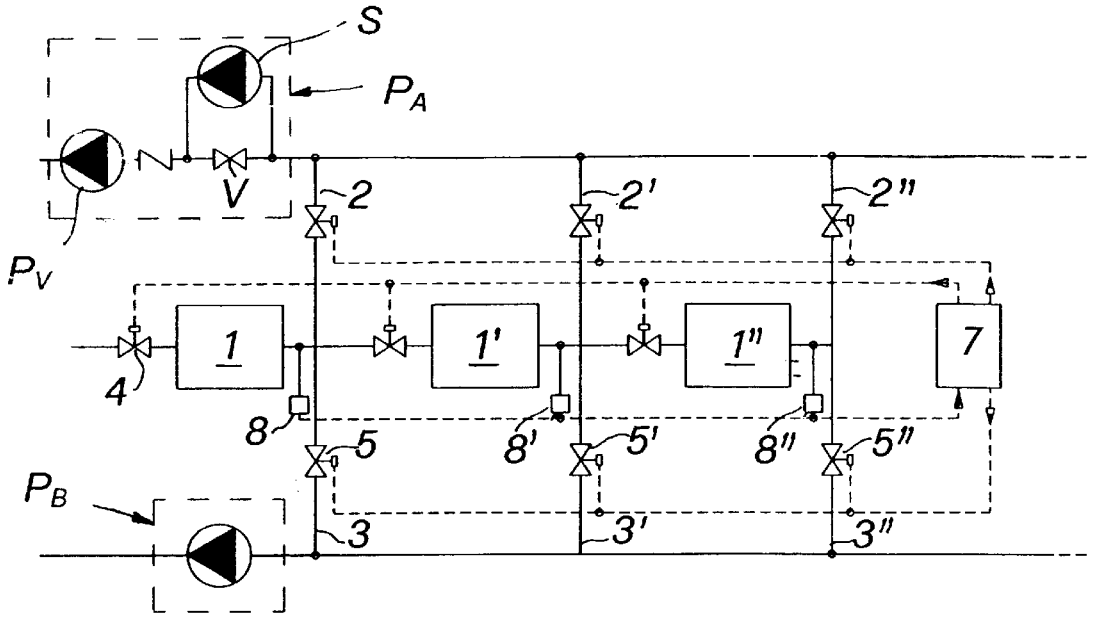
FIG. 1 is a diagram of a system according to the invention, applied to a three-bed drier.

With reference to FIG. 1, this figure schematically illustrates a drier with three evaporation beds, respectively designated by the reference numerals 1, 1', 1", which are connected to a main vacuum source, generally lines 2, 2', 2".

The vacuum source $P_A$ can be of the "high-vacuum" type, as described in the above mentioned application, i.e. it can be constituted by a vacuum pump $P_V$ which is arranged in series to a blower S which is parallel-connected to a bypass valve V. With this layout it is possible to create a vacuum of approximately 10 mbar. Of course, it is possible to use just a vacuum pump $P_V$ without altering the inventive concept.

According to the invention, the beds 1, 1', 1" may be connected, by virtue of respective lines 3, 3', 3", to a secondary vacuum source, generally designated by $P_B$, which for example is constituted by a single vacuum pump which is similar to $P_V$ but has a lower power rating and capacity and can accordingly be termed "low-vacuum" pump.

A valve means is also associated with each bed and is suitable to connect each bed either to the main vacuum source $P_A$ or to the secondary one $P_B$. Since the valve means is identical for each bed, only one valve means is described hereinafter for the sake of simplicity, designating the other ones with respective single and double primes.

The valve means of the bed 1 can be constituted by a first valve 4 which is meant to connect the bed 1 to the outside or to close it hermetically. A second valve 5 can be inserted on the line 3 to connect the bed 1 only to the secondary vacuum source $P_B$, whereas the third valve 6 is meant to connect the bed 1 to the main vacuum source $P_A$.

There is an electronic control unit 7 that receives input signals from a pressure control device 8 and sends control signals to sequentially open and close the valves 4, 5 and 6 in order to gradually reduce the pressure in each bed and achieve minimal pressure changes when the bed is connected to the main vacuum source.

The operation of the system is clearly shown in FIGS. 2 to 5, wherein the closed valves are colored in black.

Figure 2:
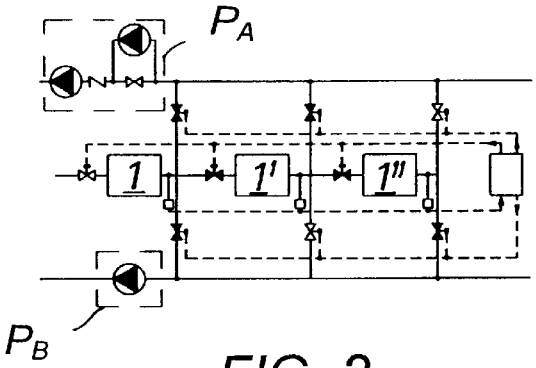
FIGS. 2 to 5 illustrate successive steps of the operation of the system shown in FIG. 1.

In FIG. 2, the bed 1 is connected to the outside environment, and this corresponds to the step of loading and unloading the hides from the bed. The bed 1' is instead connected to the secondary or low-vacuum source $P_B$ in order to gradually reduce the vacuum. The bed 1" is instead connected to the high-vacuum source $P_A$ and is at the steady-state pressure, for example 20 mbar.

Figure 3:
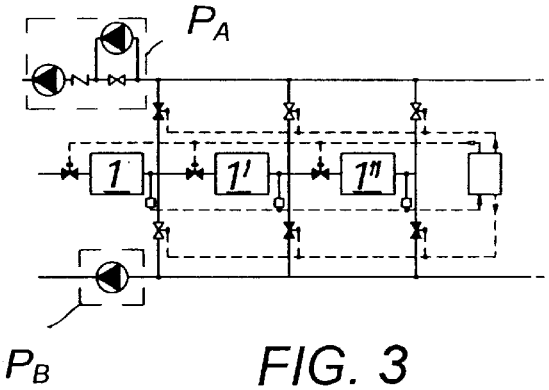

In FIG. 3, the valve 4 for connection to the outside has been closed in the bed 1. A vacuum, close in value to the steady-state vacuum, has been reached in the bed, and therefore the valve 6' has been opened, connecting it to the high-vacuum source $P_A$ exactly as in the bed 1".

Figure 4:
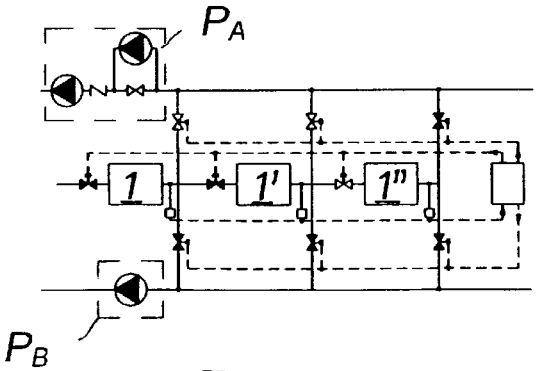
Figure 5:
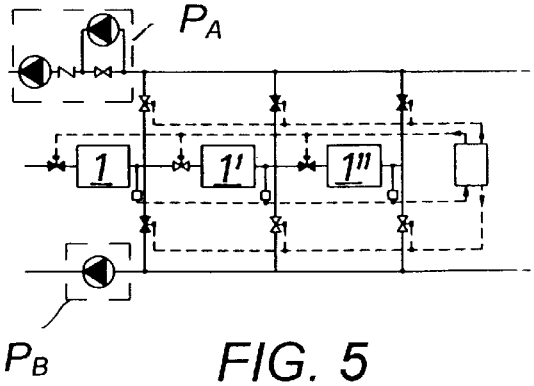

In FIGS. 4 and 5, the beds 1" and respectively 1' are connected to the outside to unload and load the hides, whereas in the other beds the pressures rise gradually by virtue of the source $P_B$ or are maintained at steady-state values by the vacuum source $P_A$.

From what has been described above it is evident that the apparatus according to the invention achieves the intended aim of gradually decreasing the pressure in one bed at a time, leaving the pressure in the remaining beds substantially unchanged and at steady-state values, eliminating the cyclic pressure variations that were typical of prior systems.

The apparatus according to the invention is susceptible to numerous modifications and variations, all of which are within the scope of the inventive concept expressed in the accompanying claims.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

I claim:

1. Stabilized vacuum apparatus for industrial hide driers with multiple evaporation beds, comprising a main vacuum source ($P_A$) that can be connected to a series of evaporation beds (1; 1'; 1") in order to create a negative pressure having a preset value in said beds, in steady-state conditions; characterized in that it has a secondary vacuum source ($P_B$)

which is suitable to produce, in one bed at a time, a negative pressure whose value is close to that of the steady-state conditions, a valve means being provided to selectively connect each bed, which is initially at ambient pressure, first to said secondary vacuum source ($P_B$) and then to said main vacuum source ($P_A$) so as to eliminate substantial pressure variations in the remaining beds when each bed is connected to the main vacuum source.

2. Apparatus according to claim 1, characterized in that said valve means comprises, for each bed, at least one first electric valve (4; 4'; 4") on a line for connection to the outside environment.

3. Apparatus according to claim 1, characterized in that said valve means comprises, for each bed, at least one second electric valve (5; 5'; 5") on a line (3; 3'; 3") for connection to said secondary vacuum source.

4. Apparatus according to claim 1, characterized in that said valve means comprises, for each bed, at least one third electric valve (6; 6'; 6") on a line (2; 2'; 2") for connection to said main vacuum source.

5. Apparatus according to claim 1, characterized in that it has a control means (7; 8; 8'; 8") which is suitable to control the cyclic sequential closure of said first electric valve (4; 4'; 4"), of said second electric valve (5; 5'; 5"), and of said third electric valve (6; 6'; 6").

6. Apparatus according to claim 1, characterized in that said main vacuum source and said secondary vacuum source comprise at least one vacuum pump which is suitable to produce an absolute pressure of 1013 to 100 mbar.

7. Apparatus according to claim 6, characterized in that said main vacuum source comprises an auxiliary suction device (S; V) which is suitable to operate in series with said first vacuum pump to reach an absolute pressure of 100 to 10 mbar.

* * * * *